US010856638B2

(12) United States Patent
Paliobeis et al.

(10) Patent No.: US 10,856,638 B2
(45) Date of Patent: Dec. 8, 2020

(54) HAIR STYLING APPLIANCE WITH DIRECTIONAL AIR FLOW VALVE AND COMPRESSED GAS

(71) Applicant: Helen of Troy Limited, St. Michael (BB)

(72) Inventors: Steve Paliobeis, El Paso, TX (US); Luke Hillebrecht, Kent, OH (US)

(73) Assignee: Helen Of Troy, St. Michael (BB)

( * ) Notice: Subject to any disclaimer, the term of this patent is extended or adjusted under 35 U.S.C. 154(b) by 45 days.

(21) Appl. No.: 16/395,506

(22) Filed: Apr. 26, 2019

(65) Prior Publication Data

US 2019/0343259 A1 Nov. 14, 2019

Related U.S. Application Data

(60) Provisional application No. 62/668,328, filed on May 8, 2018.

(51) Int. Cl.

| | |
|---|---|
| ***A45D 20/12*** | (2006.01) |
| ***A45D 1/04*** | (2006.01) |
| ***A45D 1/00*** | (2006.01) |

(52) U.S. Cl.

CPC ..... *A45D 20/12* (2013.01); *A45D 1/04* (2013.01); *A45D 2001/002* (2013.01)

(58) Field of Classification Search

CPC ..... A45D 20/00; A45D 20/12; A45D 1/00; A45D 1/04; A45D 2001/002;

(Continued)

(56) References Cited

U.S. PATENT DOCUMENTS

| | | | |
|---|---|---|---|
| 4,078,525 | A | 3/1978 | Chiba |
| 4,555,232 | A | 11/1985 | Raccah et al. |

(Continued)

FOREIGN PATENT DOCUMENTS

| | | |
|---|---|---|
| DE | 102010002292 | 8/2011 |
| DE | 102011079614 | 7/2016 |

(Continued)

OTHER PUBLICATIONS

Conair Corporation, "Conair 1875 Watt Turbo Hair Dryer", Printed From Internet Nov. 2017, 1 page.

(Continued)

*Primary Examiner* — Stephen M Gravini
(74) *Attorney, Agent, or Firm* — Egan Peterman Enders Huston

(57) ABSTRACT

In one embodiment, hair appliance is provided in which non-heated gas flow is directionally applied automatically to hair after application of a heat treatment. In another embodiment, a compressed gas source is used in conjunction with the hair appliance. The directional application of the non-heated gas is based upon the orientation of the hand held hair appliance. In one embodiment, the directional gas flow of the non-heated air is configured to provide the non-heated gas flow to a user's hair at the location at which the user's hair exits engagement with the hair appliance. In one embodiment a compressed gas source is integrated with a hand held hair appliance. In another embodiment, a hair appliance system is provided in which the compressed gas source is external to a hand held hair appliance.

18 Claims, 4 Drawing Sheets

(58) Field of Classification Search
CPC ..... A45D 2001/00; A45D 2001/00; H01M 10/0525; H01M 10/48; H01M 2/0202
USPC ..... 34/95–110
See application file for complete search history.

(56) References Cited

U.S. PATENT DOCUMENTS

| | | | | |
|---|---|---|---|---|
| 4,605,019 | A | 8/1986 | Reynolds et al. | |
| 5,009,592 | A | 4/1991 | Roldan et al. | |
| 5,155,925 | A | 10/1992 | Choi | |
| 5,400,809 | A * | 3/1995 | Adams | A45D 20/50 132/118 |
| 5,857,262 | A * | 1/1999 | Bonnema | A45D 20/06 34/97 |
| 6,895,975 | B2 * | 5/2005 | Hafemann | A45D 1/04 132/224 |
| 7,350,317 | B2 | 4/2008 | Matsui et al. | |
| 7,465,904 | B2 * | 12/2008 | Kim | A45D 1/04 132/228 |
| 7,913,416 | B1 | 3/2011 | Scieri | |
| 8,015,724 | B2 | 9/2011 | Imahori et al. | |
| 8,302,613 | B2 | 11/2012 | Yde et al. | |
| 8,347,897 | B2 | 1/2013 | Benest et al. | |
| 8,389,909 | B2 | 3/2013 | Wang et al. | |
| 8,407,913 | B2 | 4/2013 | Langly et al. | |
| 8,455,796 | B2 | 6/2013 | Leung | |
| 8,790,319 | B2 | 7/2014 | Thomason et al. | |
| 8,881,423 | B2 | 11/2014 | Ragosta et al. | |
| 9,095,196 | B2 | 8/2015 | Leung | |
| 9,788,624 | B2 | 10/2017 | Weatherly et al. | |
| 9,808,061 | B2 | 11/2017 | Ford et al. | |
| 9,839,274 | B1 * | 12/2017 | Brickner | H04B 1/3833 |
| 10,165,843 | B2 * | 1/2019 | Hedges | A45D 20/12 |
| 10,575,617 | B2 * | 3/2020 | Courtney | A45D 20/122 |
| 2002/0092196 | A1 | 7/2002 | Tobin et al. | |
| 2004/0216322 | A1 | 11/2004 | Collier et al. | |
| 2006/0070255 | A1 | 4/2006 | Kokuo et al. | |
| 2006/0108344 | A1 * | 5/2006 | Kim | A45D 1/04 219/225 |
| 2007/0068545 | A1 | 3/2007 | Dallianis et al. | |
| 2008/0236565 | A1 | 10/2008 | Boeger et al. | |
| 2010/0089413 | A1 | 4/2010 | Wright et al. | |
| 2011/0049274 | A1 | 3/2011 | Morgan et al. | |
| 2012/0272994 | A1 | 11/2012 | Sayers et al. | |
| 2013/0192625 | A1 | 8/2013 | Migliori et al. | |
| 2013/0247407 | A1 | 9/2013 | Richmond et al. | |
| 2014/0216493 | A1 | 8/2014 | Hadden | |
| 2015/0196105 | A1 | 7/2015 | Leung | |
| 2015/0320171 | A1 | 11/2015 | Moyal | |
| 2017/0095050 | A1 | 4/2017 | Dineen | |
| 2017/0127784 | A1 | 5/2017 | Rees-Jones et al. | |
| 2019/0343259 | A1 * | 11/2019 | Paliobeis | A45D 20/12 |

FOREIGN PATENT DOCUMENTS

| | | | | |
|---|---|---|---|---|
| EP | 3097815 | | 11/1916 | |
| EP | 1902643 | | 9/2009 | |
| EP | 2433519 | | 3/2012 | |
| EP | 2496110 | B1 * | 9/2018 | A45D 1/02 |
| GB | 2386553 | | 6/2004 | |
| GB | 2459507 | | 12/2010 | |
| GB | 2476450 | B * | 1/2014 | A45D 1/02 |
| KR | 100626642 | | 9/2006 | |
| KR | 20100010088 | | 2/2010 | |
| KR | 101365268 | | 2/2014 | |
| WO | 02/054902 | | 12/2001 | |
| WO | 2007/043732 | | 4/2007 | |
| WO | 2008/062293 | | 11/2007 | |
| WO | 2008/014658 | | 2/2008 | |
| WO | 2008/062293 | | 5/2008 | |
| WO | 2009/086063 | | 12/2008 | |
| WO | WO-2011055116 | A3 * | 6/2011 | A45D 1/18 |
| WO | 2012/093045 | | 7/2012 | |
| WO | 2012/127949 | | 9/2012 | |
| WO | 2013/069572 | | 5/2013 | |
| WO | 2013/142497 | | 9/2013 | |
| WO | 2016/051235 | | 4/2016 | |
| WO | 2016/110579 | | 7/2016 | |
| WO | WO-2019217092 | A1 * | 11/2019 | A45D 20/12 |

OTHER PUBLICATIONS

Conair Corporation, "Conair You Style Pro Cordless ThermaCell Curling Iron, Model TC700R 3/4 inch Barrel", Printed from Internet Nov. 2017, 1 page.
Amazon.com, "Steam Hair Straightener Fentac Hair Straightening Iron With Ultrasonic Atomization", Printed From Internet Dec. 2017, 7 pages.
Home Design Ideas, "Flat Iron: Rare Hots Flat Iron Image Concept Ulta Shot Reviews Target Warranty Cool 38 Rare Hot Tools Flat Iron Image Concept", Printed From Internet Dec. 2017, 4 pages.
Amazon.com, "LumaBella Cool Mist Hair Straightener with Macademia Conditioning Treatment & Cool Mist Infusion Channel", Printed From Internet Dec. 2017, 9 pages.
International Search Report, PCT/US19/29280, dated Sep. 24, 2019, 4 pgs.

* cited by examiner

HAIR STYLING APPLIANCE WITH DIRECTIONAL AIR FLOW VALVE AND COMPRESSED GAS

This application claims priority to Provisional Patent Application No. 62/668,328 filed May 8, 2018; the disclosure of which is expressly incorporated herein by reference.

TECHNICAL FIELD OF THE INVENTION

The techniques disclosed herein relate to hair styling appliances, and in exemplary embodiments relate to hand held hair appliances or systems utilizing hand held hair appliances.

BACKGROUND

As known in the art, hand held appliances may be provided in a variety of forms. Such appliances include, for example, hair dryers, flat irons, curling irons, etc. for applying heat treatment to hair. It is known to those skilled in the art that applying non-heated air following a heat treatment "locks-in" and maintains the heated styling effect created with the hair appliance. Application of non-heated air is often referred to as a "cool shot." Such techniques typically involve blowing ambient temperature air over hair after application of the heat treatment. Hand held appliances utilizing such techniques are often bulky as an additional fan or motor may be needed (particularly in the case of devices such as flat irons and curling irons). In addition, such devices typically only provide ambient air. Further, the application of the air may not be directed in the most efficient manner.

It would be desirable to provide a hand held hair appliance which addresses some or all of the deficiencies of the prior art techniques for applying non-heated air in a hand held hair appliance.

SUMMARY

Described herein are multiple techniques which provide advantages for applying non-heated air in a hand held hair appliance. These techniques may be utilized together or singularly as the benefits of the techniques are not required to be used in combination.

In one embodiment, a hand held hair appliance is provided in which non-heated gas flow is directionally applied to hair after application of a heat treatment. In one embodiment, an automatic valve switches the directional application of the non-heated gas based upon the orientation of the hand held hair appliance. In one embodiment, the hand held hair appliance is a flat iron and the directional gas flow of the non-heated air is configured to provide the non-heated gas flow to a user's hair at the location at which the user's hair exits engagement with the heating elements of the flat iron. Thus, as hair is pulled through the flat iron, non-heated gas is automatically applied to the hair at the point at which the hair exits the flat iron. In this manner, the hair styling effect of the flat iron is better maintained in the hair. In one embodiment, the non-heated gas is provided from a gas source. In one embodiment, the gas source may be a compressed gas source. In one embodiment, the gas may merely be air and the gas flow may result from a fan.

In another embodiment, non-heated gas that is applied in a hand held hair appliance is gas that is cooler than typical ambient temperatures. In one particular embodiment, the non-heated gas is provided from a compressed gas source. In one embodiment, the compressed gas source may be a compressed gas canister located within the hand held hair appliance. In another embodiment, the compressed gas source may be located external to the hand held hair appliance. In one embodiment, the compressed gas canister may be utilized in combination with an automatic valve which switches the directional flow of the gas based upon the orientation of the hand held appliance.

In one embodiment, a hand held hair appliance is disclosed. The hand held hair appliance comprises a heating element; one or more first gas ports; and one or more second gas ports. The hand held hair appliance further comprises a gas inlet selectively coupled to the one or more first gas ports and the one or more second gas ports. The hand held hair appliance additionally comprises a valve coupled between the gas inlet and the one or more first gas ports and coupled between the gas inlet and the one or more second gas ports, the valve selectively providing gas to the one or more first gas ports and the one or more second gas ports depending upon an orientation of the hand held hair appliance.

In another embodiment a hand held flat iron is provided. The hand held flat iron comprises a first arm and a second arm, at least one of the first arm and the second arm being moveable. The hand held flat iron further comprises at least one flat heating element, the flat heating element located on at least one of the first arm and the second arm. The hand held flat iron also comprise one or more first gas ports, the one or more first gas ports located on at least one of the first arm and the second arm. The hand held flat iron also comprises one or more second gas ports, the one or more second gas ports located on at least one of the first arm and the second arm. The hand held flat iron further comprises a gas inlet selectively coupled to the one or more first gas ports and the one or more second gas ports. The hand held flat iron also comprises a valve coupled between the gas inlet and the one or more first gas ports and coupled between the gas inlet and the one or more second gas ports, the valve selectively providing gas to either the one or more first gas ports or the one or more second gas ports depending upon an orientation of the hand held flat iron.

In still another embodiment a method of configuring a hand held hair appliance is disclosed. The method comprises providing one or more first gas ports, providing one or more second gas ports, and providing a gas inlet selectively coupled to the one or more first gas ports and the one or more second gas ports. The method further comprises configuring the hand held hair appliance to selectively provide gas to either the one or more first gas ports or the one or more second gas ports depending upon an orientation of the hand held hair appliance, wherein selectively providing gas flow provides gas flow to either the one or more first gas ports or the one or more second gas ports depending upon which of the one or more first gas ports or the one or more second gas ports corresponds to a trailing edge of the hand held hair appliance.

In yet another embodiment a hand held hair appliance is disclosed. The hand held appliance comprises a heating element, one or more first gas ports, and one or more second gas ports, the first gas ports and the second gas ports arranged to be proximate hair that would be engaged by the heating element. The hand held hair appliance further comprises a gas inlet coupled to the one or more first gas ports and the one or more second gas ports, and a chamber configured to hold a compressed gas cartridge, the chamber coupled to gas inlet to provide gas from the compressed gas cartridge to the gas inlet.

In yet another embodiment a hair appliance system is disclosed. The hair appliance system comprises a hand held hair appliance, the hand held hair appliance comprising a heating element, one or more first gas ports, one or more second gas ports, the first and second gas ports arranged to be proximate hair that would be engaged by the heating element, and a gas inlet coupled to the one or more first gas ports and the one or more second gas ports. The hair appliance system further comprises an external housing configure to hold a compressed gas cartridge, the external housing external to the hand held hair appliance. The hair appliance system also comprises a gas conduit coupled between the external housing and the hand held hair appliance, the gas conduit providing a gas flow path between the external housing and the hand held hair appliance.

It will be recognized that the use of the compressed gas and directional gas flow techniques described herein may be utilized independently of each other. Alternatively, the use of the compressed gas and directional gas flow techniques described herein may be used in combination.

BRIEF DESCRIPTION OF THE DRAWINGS

A more complete understanding of the present inventions and advantages thereof may be acquired by referring to the following description taken in conjunction with the accompanying drawings, in which like reference numbers indicate like features. It is to be noted, however, that the accompanying drawings illustrate only exemplary embodiments of the disclosed concepts and are therefore not to be considered limiting of the scope, for the disclosed concepts may admit to other equally effective embodiments.

Figure 1:
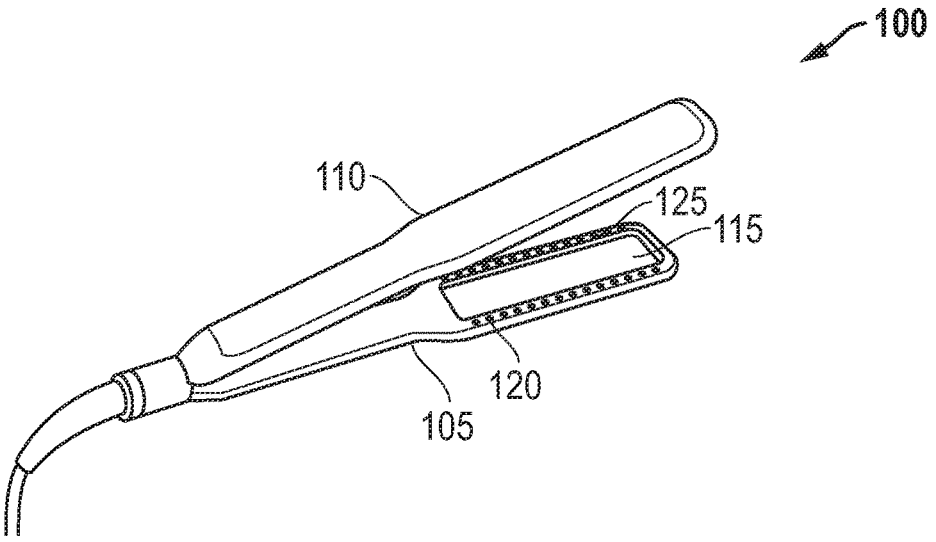
FIG. 1 illustrates one embodiment of a hand held hair appliance utilizing techniques described herein.

While the embodiments of hair styling appliances and methods disclosed herein are susceptible to various modifications and alternative forms, specific embodiments thereof are shown by way of example in the drawings and will herein be described in detail. It should be understood, however, that the drawings and detailed description thereto are not intended to limit the disclosure to the particular form disclosed, but on the contrary, the disclosure is intended to cover all modifications, equivalents and alternatives falling within the spirit and scope of the present disclosure as defined by the appended claims.

DETAILED DESCRIPTION

In one embodiment, a hand held hair appliance is provided in which non-heated gas flow is directionally applied to hair after application of a heat treatment. In one embodiment, an automatic valve switches the directional application of the non-heated gas based upon the orientation of the hand held hair appliance. In one embodiment, the hand held hair appliance is a flat iron and the directional gas flow of the non-heated air is configured to provide the non-heated gas flow to a user's hair at the location at which the user's hair exits engagement with the heating elements of the flat iron. Thus, as hair is pulled through the flat iron, non-heated gas is automatically applied to the hair at the point at which the hair exits the flat iron. In this manner, the hair styling effect of the flat iron is better maintained in the hair. In one embodiment, the non-heated gas is provided from a gas source. In one embodiment, the gas source may be a compressed gas source. In one embodiment, the gas may merely be air and the gas flow may result from a fan.

In another embodiment, non-heated gas that is applied in a hand held hair appliance is gas that is cooler than typical ambient temperatures. In one particular embodiment, the non-heated gas is provided from a compressed gas source. In one embodiment, the compressed gas source may be a compressed gas canister located within the hand held hair appliance. In another embodiment, the compressed gas source may be located external to the hand held hair appliance. In one embodiment, the compressed gas canister may be utilized in combination with an automatic valve which switches the directional flow of the gas based upon the orientation of the hand held appliance.

It will be recognized that the use of the compressed gas and directional gas flow techniques described herein may be utilized independently of each other. Alternatively, the use of the compressed gas and directional gas flow techniques described herein may be used in combination.

One embodiment of a hair appliance for use of the techniques disclosed herein is a flat iron. FIG. 1 illustrates a hand held hair appliance 100 which in the example of FIG. 1 is a flat iron. It will be recognized, however, that some or all of the techniques disclosed herein may be utilized in any of a wide range of other hair appliances. For example, other exemplary hair appliances include, but are not limited to, hair dryers, hair curling irons, hair straighteners, etc. The hand held hair appliance 100 includes a first arm 105 and a second arm 110. A heating element 115 is also provided as part of the second arm 110 for imparting heat to a user's hair. Though not shown in the perspective view of FIG. 1, a similar heating element may be contained in the first arm 105. In the embodiment shown, the heating element is the flat heater of a flat iron hair appliance. It will be recognized that in other hair appliance embodiments, the heating element may be a heated barrel of a curling iron, the heated air output of a hair dryer, etc. since the particular embodiment of the heating element may depend upon the particular type and configuration of hand held hair appliance.

A plurality of first gas ports 120 and a plurality of second gas ports 125 are also provided as shown in FIG. 1 for operating as gas ports. Though not shown, the second arm 110 may further include two sets of gas ports adjacent a heating element, similar to that contained in the first arm 105. Though the first gas ports 120 and the second gas ports 125 are shown in the figures as each being a plurality of ports, it will be recognized that only one first gas port 120 and only one second gas port 125 may be utilized. In one embodiment, with only a single gas port, the gas port may be configured to be an elongated slot so as to provide gas along a length of the arms. As discussed below, gas may be provided out the gas ports. In one embodiment, the gas may be provided from a compressed gas source. In another embodiment, the gas may merely be air, such as air forced from a fan.

Figure 2:
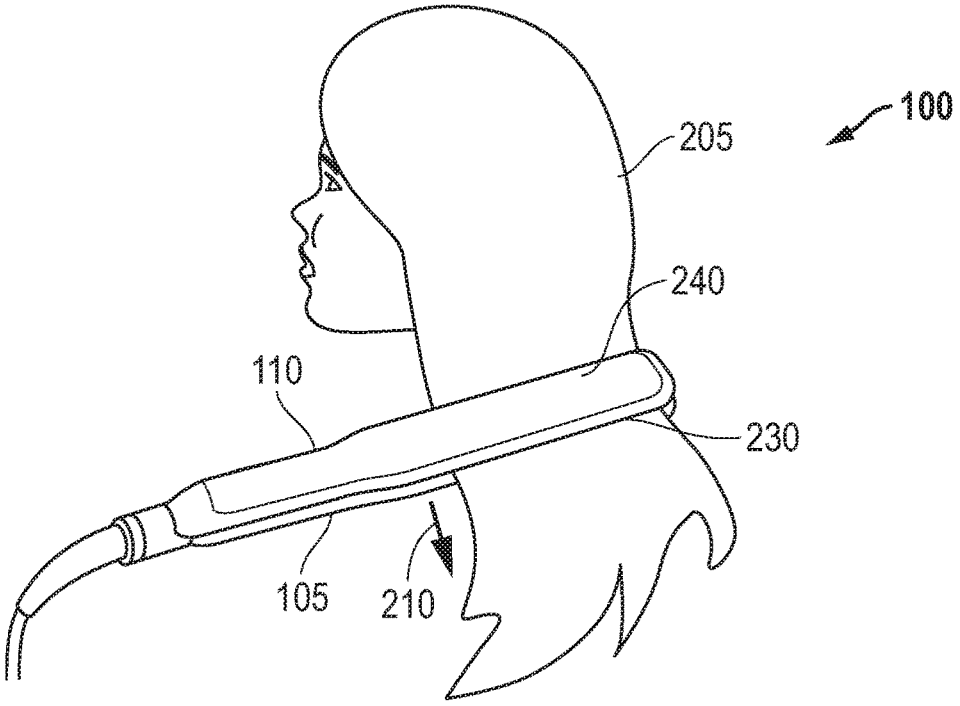
FIG. 2 illustrates the embodiment of the hand held hair appliance of FIG. 1 in use.

FIG. 2 illustrates an exemplary use of the hand held hair appliance 100 of FIG. 1. As shown in FIG. 2, the hand held hair appliance 100 engages a user's hair 205. In the exemplary embodiment shown (a flat iron), the user's hair 205 is engaged between the first arm 105 and the second arm 110.

In operation, a user may pull the hand held hair appliance 100 through the user's hair in the direction of movement indicated by arrow 210. As shown in FIG. 2 any particular portion of the user's hair 205 will first engage a leading edge 230 of the hand held hair appliance 100 and will exit the hand held hair appliance 100 at a trailing edge 240. It will be recognized that either side of the hand held hair appliance 100 may be the leading edge 230 or the trailing edge 240 depending upon what direction the hand held hair appliance is oriented in and which direction the appliance is moved relative to the hair.

Figure 3:
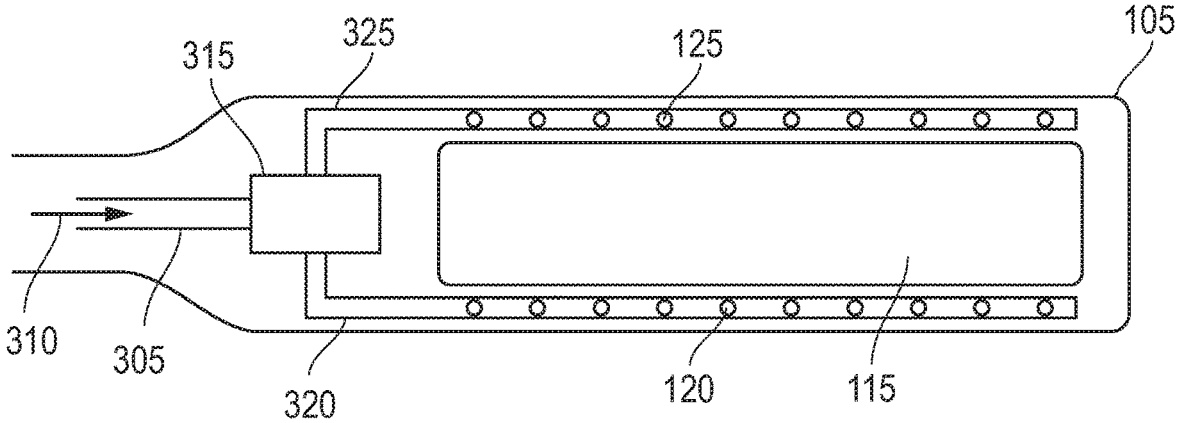
FIG. 3 illustrates one embodiment of the arm of the hand held hair appliance of FIG. 1.

FIG. 3 illustrates one exemplary embodiment of the hand held hair appliance 100 in which the embodiment includes directional gas flow through the gas ports. It will be recognized that the use of directional gas flow may be utilized in combination with other embodiments disclosed herein, may be used independent of those other embodiments, or may not be utilized at all and merely those other embodiments may be utilized. FIG. 3 illustrates a top side view of first arm 105. As shown, heating element 115 is flanked by first gas ports 120 and second gas ports 125. First gas ports 120 are coupled to first gas channel 320 and second gas ports 125 are coupled to second gas channel 325. The first gas channel 320 and the second gas channel 325 are coupled through a valve 315 to a gas inlet 305. Gas may be provided into the gas inlet 305 in the gas flow direction indicated by arrow 310. Thus, gas may flow from the gas inlet 305 through the valve 315 to the first gas channel 320 and/or second gas channel 325 for exit through the first gas ports 120 and/or second gas ports 125. Gas provided at gas inlet 305 may be provided from a gas source (not shown). In one embodiment, the gas source may be a compressed gas source (as discussed more below). In another embodiment, the gas source may be a fan. In one embodiment, the gas may carbon dioxide provided from a gas compressed gas source. In another embodiment, the gas may merely be air (compressed or not). In one embodiment, the gas source is a fan blowing ambient air. As discussed more below, the use of a compressed gas source allows for the provision of a gas that is cooler than the ambient air. In operation, gas may be provided from the gas source when desired by the user. For example, a button (not shown) may be provided on the hand held appliance which the user presses to actuate the flow of gas from a gas source to the gas channels. In this manner, a user may selectively actuate the flow of gas to provide a gas for use in styling. The gas flow may be configured to be continuous or may be configured to be a single "shot," thus providing a "cool shot" effect.

Valve 315 allows for the gas from the gas inlet 305 to be selectively provided to one or both of the first gas channel 320 and second gas channel 325 so that selective gas flow is provided. In one embodiment, the valve 315 selectively provides the gas from the gas inlet to only one of the gas channels. In this manner, the gas may be directed to just one set of the gas ports (either the first gas ports 120 or second gas ports 125). In one embodiment, the valve 315 may automatically operate to direct the gas to the desired one of the first gas channel or the second gas channel. More specifically, in one example, the valve 315 may be configured to provide the gas flow only to the gas ports that are at the leading edge 230 of operation or the trailing edge 240 of operation. It will be recognized that depending upon the particular user operation (direction the user is holding the hand held hair appliance 100 and/or direction of movement), either of the first gas ports 120 or the second gas ports may be associated with the leading edge 230 or the trailing edge 240. In one embodiment, the choice of which set of gas ports that are utilized may be chosen such that gas only flows to the gas ports that are associated with the trailing edge. In this manner, gas is provided to the user's hair 205 as the hair exits engagement with heating element 115. Thus, the heated hair may be better "set" by applying a gas flow to the hair after application of the heat. In one embodiment, the gas may be cooler than ambient air to improve the hair setting action.

In one embodiment, the selection of which gas channel and gas ports receive the gas flow may be performed automatically so as to provide gas to the gas ports at the trailing edge of the hand held hair appliance. Thus, automatic provision of selective gas flow is provided. In one embodiment, the valve 315 may automatically detect orientation and/or direction of movement. In another embodiment, the valve 315 may receive an input signal from an orientation sensor and/or movement direction sensor. In either embodiment, the selection of the appropriate gas channel and gas ports may be automatic without requiring user intervention to make such selection.

Though shown and described in FIG. 3 with regard to first arm 105, it will be recognized that second arm 110 may be configured in a symmetric manner with similar features to that shown in FIG. 3. In yet another embodiment, only one gas inlet 305 and valve 315 may be provided in the hand held hair appliance 100 and appropriate gas channels extending from the valve to each arm may be provided. It will be recognized that still further embodiments and configurations may advantageously utilize the concepts described herein. In yet another example, only one arm of the hand held hair appliance 100 may utilize the gas ports shown. Thus, the concept of directionally selecting which edge of the hand hair appliance to apply gas may be accomplished in a wide variety of manners. Further, the automatic selection of such edge may be further accomplished in a wide variety of manners.

Figure 4:
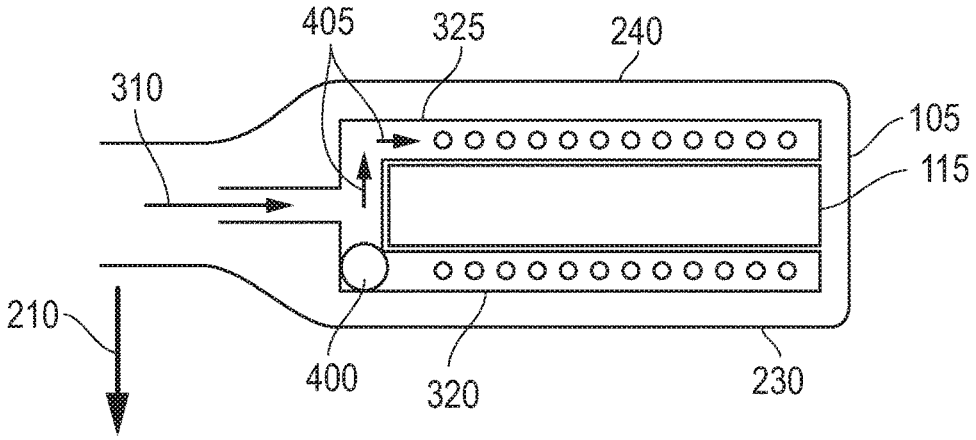
FIGS. 4 and 5 illustrate another embodiment of the arm of the hand held hair appliance of FIG. 1.
Figure 5:
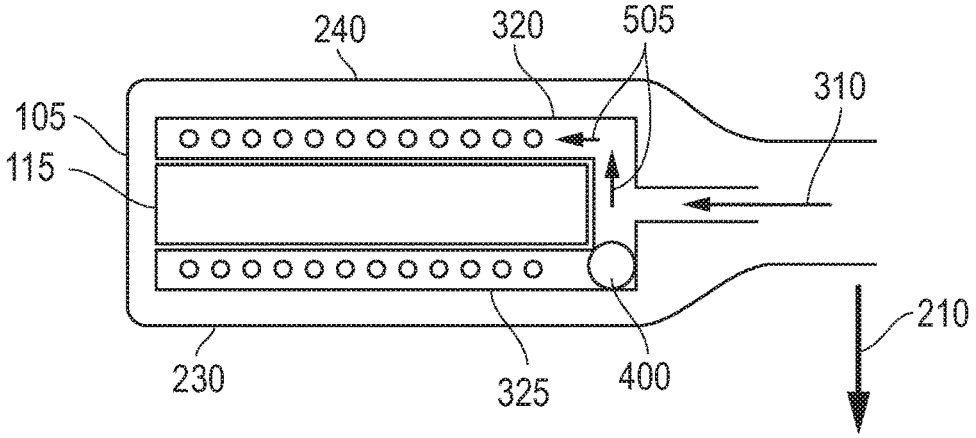

In one embodiment, the valve 315 may formed using a ball valve 400 as shown in FIGS. 4 and 5. It will be recognized that the use of a ball valve is merely exemplary and many other valve arrangements may be chosen. As shown in FIG. 4, the first arm 105 is oriented by a user in a vertical direction for pulling the hand held hair appliance through a user's hair in the direction of arrow 210. In such an orientation the second gas channel 325 is oriented vertically above the first gas channel 320. The effect of gravity will thus cause the ball of the ball valve 400 to fall to the position shown in FIG. 4. In such position, the ball valve 400 blocks air flow from the first gas channel 320 and directs the gas flow to the second gas channel 325 and the associated gas ports as indicated by gas flow arrows 405. In this manner, gas flow will exit the hand held hair appliance at the edge of the device that is associated with the trailing edge 240. In this manner all of the gas flow is concentrated to the appropriate edge to provide a "setting" function on the heated hair as it exits engagement with the heating element 115. FIG. 5 is similar to that as FIG. 4, except in the embodiment of FIG. 5 the user has flipped the orientation of the hand held hair appliance 100. Thus as shown in FIG. 5, though the first arm 105 is still held vertically and the direction of movement is the same as indicated by arrow 210, the gas channel (and associated gas ports) that correspond to the trailing edge 240 is flipped as compared to FIG. 4. More specifically, as shown in FIG. 5, the first gas channel 320 is now associated with the trailing edge 240. In this case, the effect of gravity pulls the ball of the ball valve 400 in a manner to block second gas channel 325 and direct all air flow to first gas channel 320 as indicated by gas flow direction arrows 505. In this manner, the orientation of the hand held hair appliance is automatically detected so as to direct gas flow to the trailing edge. In the example, shown, the automatic selection is achieved through the use of a ball valve which relies upon gravitational forces to appropriately switch the valve. Other mechanisms and sensors may be utilized, however, while still obtaining the advantages described herein.

As described above, the gas utilized to assist in setting the heated hair may be ordinary air or some other gas. Further, the gas may be at a temperature cooler than ambient or not. In addition, the gas may be provided via a fan or may be provided from a compressed gas source. In one embodiment, a compressed gas source is utilized. In such an embodiment, the gas temperature released from the gas source provides a relatively cool gas stream, at a lower temperature than the ambient so as to assist in providing a better "setting" action on the hair. In one embodiment, the gas is carbon dioxide though compressed air or other gases could also be utilized. The gas source for the compressed gas may be contained integral with the hand held appliance or may be separate from the hand held hair appliance (for example, tubing connecting the gas source and the hand held hair appliance).

Figure 6:
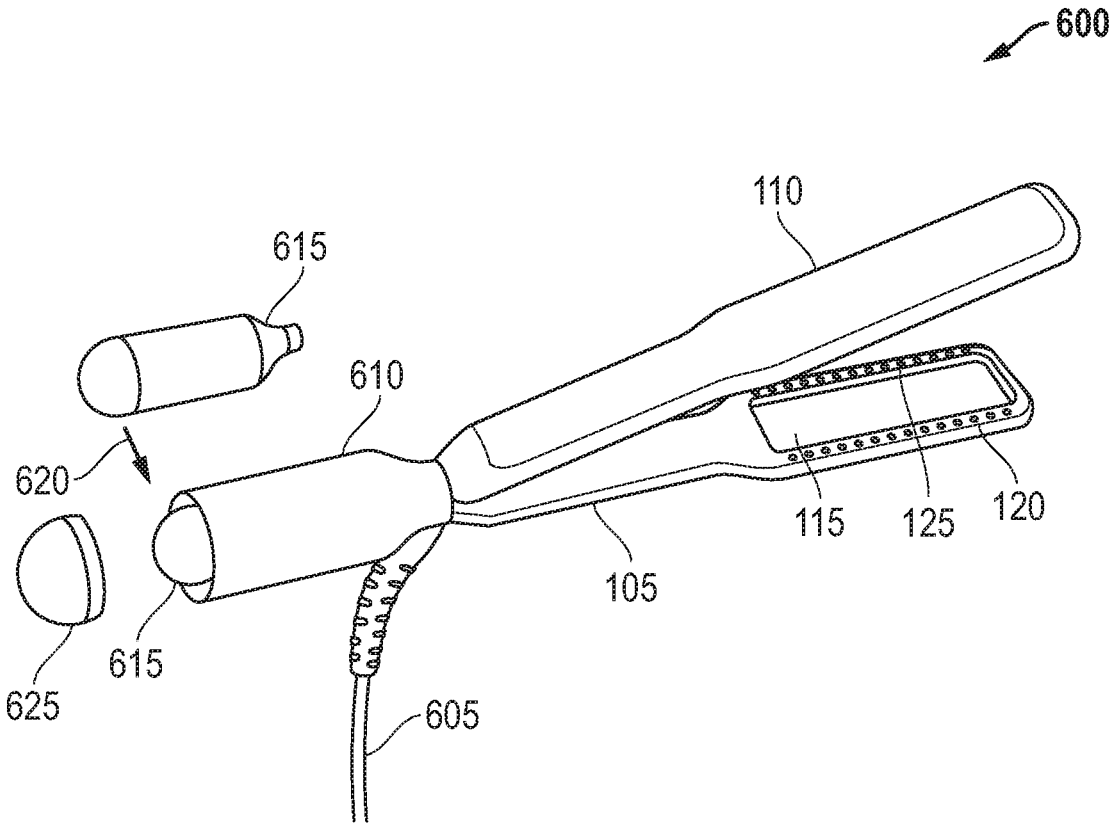
FIG. 6 illustrates a compressed gas embodiment of a hand held hair appliance.

An exemplary hand held hair appliance 600 incorporating a compressed gas source is shown in FIG. 6. As shown in FIG. 6, as with the appliance of FIG. 1, the hand held hair appliance 600 includes a first arm 105, second arm 110, heating element 115, first gas ports 120 and second gas ports 125. Further, as shown, the hand held hair appliance 600 has a power cord 605. A gas chamber 610 is provided for holding a gas cartridge 615 (for example a compressed gas cartridge) which may be inserted in the hand held hair appliance 600 as shown by arrow 620. A chamber lid 625 may also be provided to access the gas chamber 610 for insertion of the gas cartridge 615 in the gas chamber 610. In operation, the gas cartridge may supply gas from the gas chamber to the first gas ports 120 and/or second gas ports 125 as described above. In one embodiment, the gas cartridge 615 holds compressed carbon dioxide, though other gases may be utilized.

Figure 7:
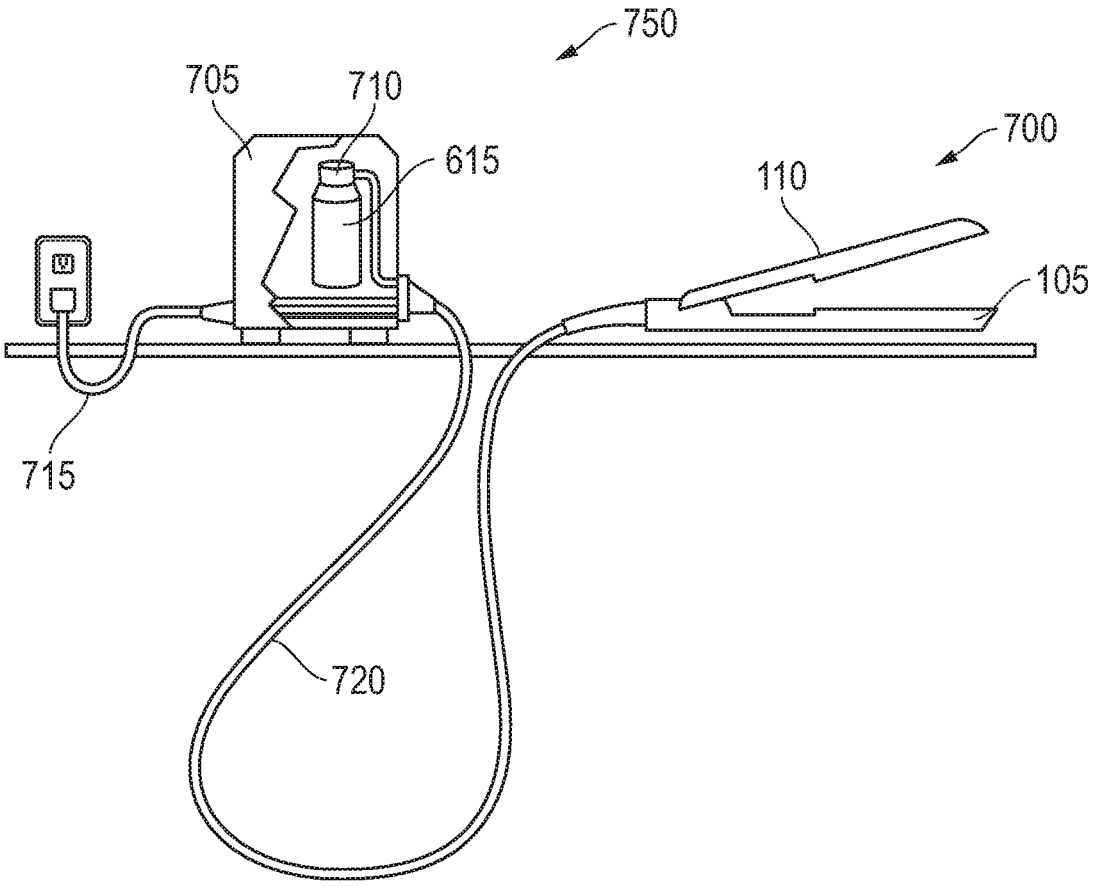
FIG. 7 illustrate a compressed gas embodiment of a hair appliance system.
Figure 8:
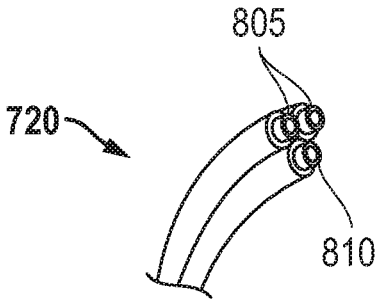
FIG. 8 illustrates an embodiment of a cord of the hair appliance system of FIG. 7.

In an alternative exemplary compressed gas embodiment, the gas cartridge need not be integrated with the hand held hair appliance. An example of such an embodiment is shown in FIG. 7. As shown in FIG. 7, a hand held hair appliance 700 includes a first arm 105 and second arm 110 similar to those described above. In the embodiment of FIG. 7, a gas cartridge 615 is contained within an external housing 705. Thus, a hair appliance system 750 (in this case a flat iron system) is provided that includes the hand held hair appliance 700 and the external housing 705. A power connection 715 is provided along with a cord 720. An actuator 710 may be provided to provide gas from the gas cartridge 615 to the cord 720. The actuator may be configured to be wired to a button on the hand held hair appliance or may be configured to be wirelessly connected to such a button. The cord 720 may be configured to contain both electrical wiring 805 and gas conduit 810 as shown in FIG. 8. The electrical wiring 805 may provide electrical power to the hand held hair appliance. The electrical wiring 805 may also provide electrical signals to the actuator 710 for control of the actuator if the actuator is controlled via hard wiring. Gas conduit 810 provides gas from the gas cartridge 615 to the gas inlet of the hand held hair appliance.

Further modifications and alternative embodiments of this invention will be apparent to those skilled in the art in view of this description. It will be recognized, therefore, that the present invention is not limited by these example arrangements. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the implementations and architectures. For example, equivalent elements may be substituted for those illustrated and described herein and certain features of the invention may be utilized independently of the use of other features, all as would be apparent to one skilled in the art after having the benefit of this description of the invention.

What is claimed is:

1. A hand held hair appliance, comprising:

a heating element;

one or more first gas ports;

one or more second gas ports;

a gas inlet selectively coupled to the one or more first gas ports and the one or more second gas ports; and a valve coupled between the gas inlet and the one or more first gas ports and coupled between the gas inlet and the one or more second gas ports, the valve selectively providing gas to the one or more first gas ports and the one or more second gas ports automatically, wherein an automatic selective provision of gas is dependent upon an orientation of the hand held hair appliance.

2. The hand held hair appliance of claim 1, wherein said valve is a ball valve.

3. The hand held hair appliance of claim 1, wherein the automatic selective provision of gas provides gas flow to either the one or more first gas ports or the one or more second gas ports depending upon which of the one or more first gas ports or the one or more second gas ports corresponds to a trailing edge of the hand held hair appliance.

4. The hand held hair appliance of claim 1, further comprises a chamber for holding a compressed gas cartridge.

5. The hand held hair appliance of claim 4, further comprising the compressed gas cartridge.

6. The hand held hair appliance of claim 1, further comprising a gas conduit, the gas conduit configured to receive compressed gas from a gas source external to the hand held hair appliance.

7. A hand held flat iron, comprising a first arm;

a second arm, at least one of the first arm and the second arm being moveable;

at least one flat heating element, the flat heating element located on at least one of the first arm and the second arm;

one or more first gas ports, the one or more first gas ports located on at least one of the first arm and the second arm;

one or more second gas ports, the one or more second gas ports located on at least one of the first arm and the second arm;

a gas inlet selectively coupled to the one or more first gas ports and the one or more second gas ports; and a valve coupled between the gas inlet and the one or more first gas ports and coupled between the gas inlet and the one or more second gas ports, the valve selectively providing gas to either the one or more first gas ports or the one or more second gas ports automatically, wherein an automatic selective provision of gas is dependent upon an orientation of the hand held flat iron.

8. The hand held flat iron of claim 7, wherein said valve is a ball valve.

9. The hand held flat iron of claim 7, wherein the automatic provision of selective gas flow provides gas flow to either the one or more first gas ports or the one or more second gas ports depending upon which of the one or more first gas ports or the one or more second gas ports corresponds to a trailing edge of the hand held flat iron.

10. The hand held flat iron of claim 7, wherein the gas is provided from a compressed gas source.

11. The hand held flat iron of claim 7, wherein the gas is air.

12. The hand held flat iron of claim 7 wherein the one or more first gas ports are located on the first arm and the one or more first gas ports are located on the second arm and wherein the one or more second gas ports are located on the first arm and the one or more second gas ports are located on the second arm.

13. A method of configuring a hand held hair appliance, the method comprising:

providing one or more first gas ports;

providing one or more second gas ports;

providing a gas inlet selectively coupled to the one or more first gas ports and the one or more second gas ports; and configuring the hand held hair appliance to selectively provide gas to either the one or more first gas ports or the one or more second gas ports automatically, wherein an automatic selective provision of gas is dependent upon an orientation of the hand held hair appliance, wherein selectively providing gas flow provides gas flow to either the one or more first gas ports or the one or more second gas ports depending upon which of the one or more first gas ports or the one or more second gas ports corresponds to a trailing edge of the hand held hair appliance.

14. The method of claim 13, wherein an automatic valve operates to provide selective gas flow to the one or more first gas ports or the one or more second gas ports.

15. The method of claim 14, wherein said automatic valve is a ball valve.

16. The method of claim 13, wherein the gas is provided from a compressed gas source.

17. The method of claim 16, wherein the compressed gas source is contained within the hand held hair appliance.

18. The method of claim 16, wherein the gas is air.

* * * * *